US007115668B2

(12) United States Patent
Belmonte et al.

(10) Patent No.: US 7,115,668 B2
(45) **Date of Patent: *Oct. 3, 2006**

(54) PROCESS FOR THE PRODUCTION IN CONTINUOUS OF HYDROCARBONS FROM SYNTHESIS GAS

(75) Inventors: Giuseppe Belmonte, Turin (IT); Vincenzo Calemma, San Donato Milanese (IT)

(73) Assignees: ENI S.p.A., Rome (IT); Institut Francais du Petrole, Rueil-Malmaison (FR); Enitecnologie S.p.A., San Donato Milanese (IT)

( * ) Notice: Subject to any disclaimer, the term of this patent is extended or adjusted under 35 U.S.C. 154(b) by 167 days.

This patent is subject to a terminal disclaimer.

(21) Appl. No.: 10/845,109

(22) Filed: May 14, 2004

(65) Prior Publication Data

US 2004/0266894 A1 Dec. 30, 2004

(30) Foreign Application Priority Data

May 22, 2003 (IT) ..... MI2003A1029

(51) Int. Cl.
*C07C 27/00* (2006.01)

(52) U.S. Cl. ..... 518/700; 518/705; 518/715; 518/721

(58) Field of Classification Search ..... 518/700, 518/705, 715, 721
See application file for complete search history.

(56) References Cited

U.S. PATENT DOCUMENTS

| | | | | |
|---|---|---|---|---|
| 5,527,473 | A | 6/1996 | Ackerman | |
| 5,900,159 | A * | 5/1999 | Engel et al. | 210/788 |
| 6,121,333 | A | 9/2000 | Clerici et al. | |
| 6,156,809 | A | 12/2000 | Clark et al. | |
| 6,214,237 | B1 * | 4/2001 | Kustra et al. | 210/709 |

FOREIGN PATENT DOCUMENTS

| | | |
|---|---|---|
| DE | 32 45 318 A1 | 6/1984 |
| EP | 0 412 785 A1 | 2/1991 |
| WO | WO 03/004582 A2 | 1/2003 |

* cited by examiner

*Primary Examiner*—J. Parsa
(74) *Attorney, Agent, or Firm*—Oblon, Spivak, McClelland, Maier & Neustadt, P.C.

(57) ABSTRACT

Hydrocarbons are prepared, which are liquid at the reaction temperature, by feeding synthesis gas into three-phase turbulent reactors in which the solid phase, consisting of the catalyst in the form of particles, is kept in suspension in the liquid phase by the rising synthesis gas. The reaction product is extracted in continuous, together with the catalyst dispersed therein, and sent to a separation section which comprises a primary filtration unit and a micro/ultra-filtration unit.

16 Claims, 1 Drawing Sheet

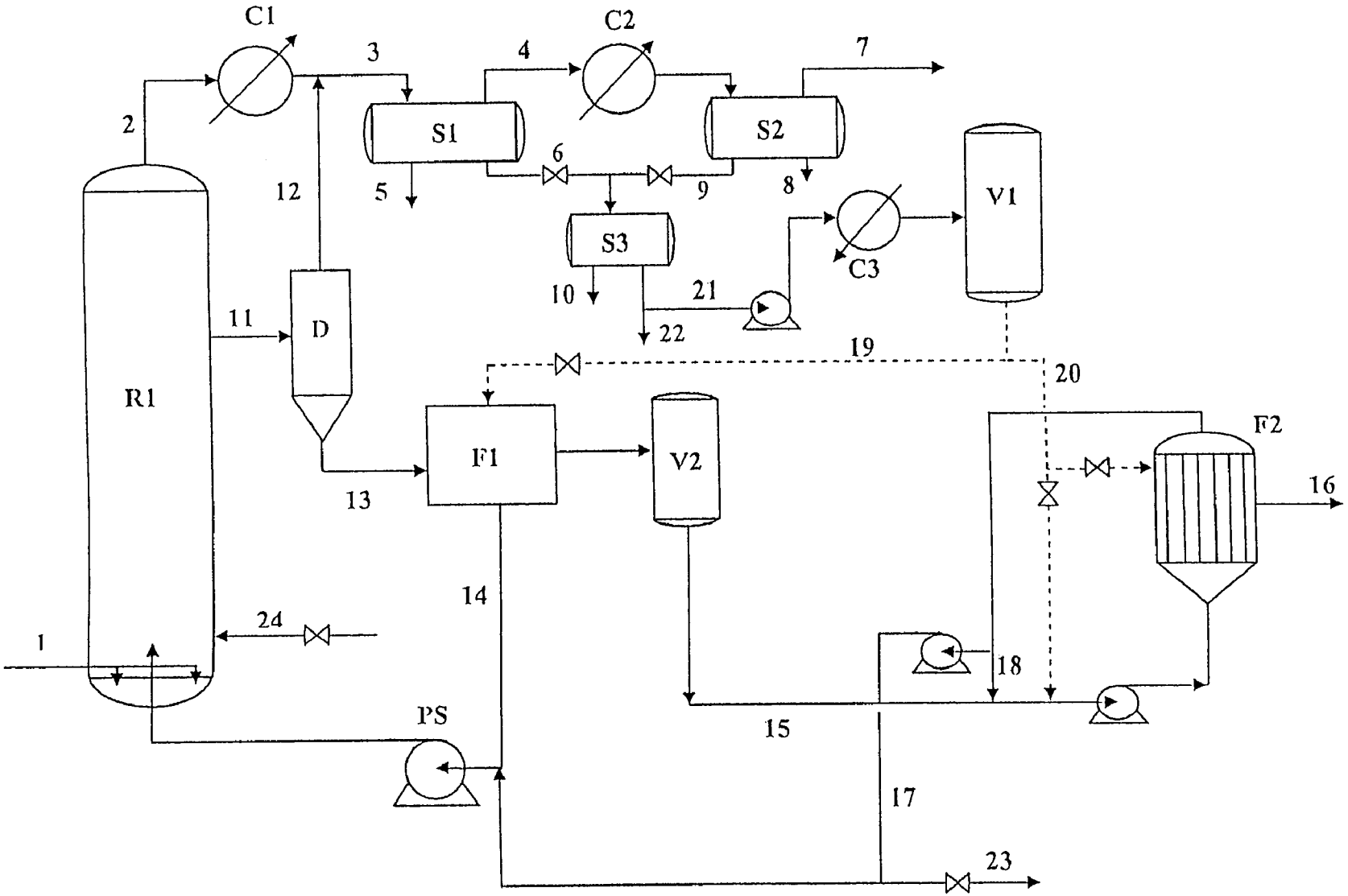
R1
C1
C2
C3
S1
S2
S3
D
F1
F2
V1
V2
PS
1
2
3
4
5
6
7
8
9
10
11
12
13
14
15
16
17
18
19
20
21
22
23
24

PROCESS FOR THE PRODUCTION IN CONTINUOUS OF HYDROCARBONS FROM SYNTHESIS GAS

The present invention relates to a process for the production in continuous of hydrocarbons starting from synthesis gas.

More specifically, the present invention relates to a process for the production in continuous of hydrocarbons starting from gaseous mixtures based on CO and $H_2$, by means of the Fischer-Tropsch technology.

DISCUSSION OF THE BACKGROUND

The Fischer-Tropsch technology is known in literature, for preparing hydrocarbons from mixtures of gas based on hydrogen and carbon monoxide, conventionally known as synthesis gas. A compendium which summarizes the main works on the Fischer-Tropsch synthesis reaction is contained in the Bureau of Mines Bulletin, 544, (1955) entitled "Bibliography of the Fischer-Tropsch Synthesis and Related Processes" H. C. Anderson, J. L. Wiley and A. Newell.

The Fischer-Tropsch technology is generally based on the use of slurry reactors, reactors which are normally used in relation to chemical reactions which are carried out in three-phase systems in which a gaseous phase is bubbled into a suspension of a solid in a liquid. The gaseous phase consists of synthesis gas, with a molar ratio $H_2$/CO ranging from 1 to 3, the dispersing liquid phase at a high temperature, represents the reaction product, or mainly linear hydrocarbons with a high number of carbon atoms, and the solid phase is represented by the catalyst.

The reaction product which is discharged from the reactor therefore consists of a suspension which must be treated to separate the solid (catalyst) from the liquid phase. Whereas the catalyst is recycled to the synthesis reactor, the liquid is subjected to subsequent treatment, for example hydrocracking and/or hydro-isomerization treatment, to obtain hydrocarbon fractions of industrial interest.

European patent 609,079 describes a reactor for Fischer-Tropsch reactions consisting of a gas-bubbling tower containing a suspension consisting of particles of catalyst suspended in the liquid hydrocarbon. The synthesis gas is fed to the base of the reactor whereas the synthesized hydrocarbon is recovered at the head.

In order to avoid the entrainment of catalyst particles, the reactor is equipped with cylindrical filtration devices internally arranged in its upper part.

International patent application WO 97/31693 describes a method for separating a liquid from a suspension of solid particles which comprises, in a first phase, degasifying the suspension and, in a second phase, filtering the suspension through a tangential flow. In particular, the suspension comes from a Fischer-Tropsch reactor and consists of synthesized heavy hydrocarbons which entrain the catalyst particles.

Other examples of methods for separating the catalyst contained in the suspension leaving a Fischer-Tropsch reactor are described in European patent 592,176, international patent application WO 94/16807, English patent 2,281,224, U.S. Pat. Nos. 4,605,678 and 5,324,335 and German patent 3,245,318.

A disadvantage associated with Fischer-Tropsch processes, for example with those mentioned above, and in particular Fischer-Tropsch processes in which the catalyst is based on cobalt, is that a liquid hydrocarbon is produced, which, in the subsequent transformation phases (hydroisomerization and/or hydrocracking), causes an alteration in the performances of the corresponding catalysts.

SUMMARY OF THE INVENTION

The Applicants have surprisingly found a Fischer-Tropsch process for the production in continuous of hydrocarbons, using slurry reactors, which allows a reaction product to be obtained, consisting of paraffinic waxes which can then be processed in subsequent upgrading treatment, such as hydroisomerization and/or hydrocracking processes, without coming up against the drawbacks of the known art, i.e. without causing an alteration in the performances of the corresponding catalysts.

BRIEF DESCRIPTION OF THE DRAWINGS

Process Schematic

DETAILED DESCRIPTION OF THE INVENTION

An object of the present invention therefore relates to a process for the production in continuous of hydrocarbons from synthesis gas which comprises:

a. continuously feeding to the bottom of a reactor for Fischer-Tropsch reactions, containing in suspension in the reaction product, a catalyst based on supported cobalt, a synthesis gas consisting essentially of hydrogen and carbon monoxide in molar ratios $H_2$/CO ranging from 1 to 3;

b. continuously discharging from the head of the reactor, a vapour stream consisting essentially of light reaction products and non-reacted reaction gas;

c. continuously discharging from the reactor, the heavy reaction product consisting essentially of a liquid hydrocarbon phase containing the catalyst, in suspension;

d. condensing the light hydrocarbon products and sending at least part of them to a collection container maintained under pressure and at a temperature higher than 150° C. and the possible remaining part to be discharged, at room temperature, or to a subsequent treatment unit, for example hydrocracking and/or hydroisomerization;

e. subjecting the heavy reaction product to a separation treatment which comprises:

$e_1$ degasification;

$e_2$ primary separation of the liquid from the solid; and $e_3$ micro/ultra-filtration of the fine or sub-micronic particles, still contained in the liquid after the primary separation, by means of membranes with an average pore diameter ranging from 0.002 to 0.1 μm;

f. sending the heavy reaction product, in liquid phase, having a content of fine or sub-micronic particles lower than 5 ppm to a subsequent treatment unit, for example hydrocracking and/or hydro-isomerization, or discharging it and cooling it to room temperature;

g. recycling to the reaction reactor the solids coming from the primary separation and micro/ultrafiltration steps; and h. periodically washing the separation and micro/ultrafiltration devices by means of flushings with the light hydrocarbon condensate.

According to the process, object of the present invention, the reactor for Fischer-Tropsch reactions is a bubble reactor consisting of a vessel, generally vertical, for example a tower, inside which chemical reactions are triggered, which take place in three-phase systems in which a gaseous/vapour phase is bubbled into a suspension of a solid in a liquid. In the present case, the gaseous/vapour phase essentially consists of the synthesis gas and light reaction products in vapour phase, the dispersing liquid phase is the heavy reaction product or linear hydrocarbons, essentially with a high number of carbon atoms, and the solid phase is represented by the catalyst.

The synthesis gas preferably comes from the steam reforming and/or partial oxidation of natural gas or other hydrocarbons, on the basis of the reactions described, for example, in U.S. Pat. No. 5,645,613. Alternatively, the synthesis gas can come from other production techniques such as, for example, autothermal reforming, C.P.O. (Catalytic Partial Oxidation) or the gasification of carbon, or other carbonaceous products, with high temperature water vapour as described in "Catalysis Science and Technology", Vol. 1, Springer-Verlag, New York, 1981.

Two phases are substantially produced from the Fischer-Tropsch reaction, a lighter phase, in vapour phase, consisting essentially of a mixture of light hydrocarbons, with from 1 to 25 carbon atoms and a boiling point at atmospheric pressure, for the $C_5$–$C_{25}$ fraction, equal to or lower than about 150° C. and reaction by-products, such as water vapour, ethers or alcohols.

This stream, together with the non-reacted reaction gas, is cooled in order to condense and separate the light hydrocarbons from the water generated by the reaction and from the other by-products. At least part of these liquid hydrocarbon products, consisting essentially of mixtures of $C_5$–$C_{25}$ hydrocarbons, is accumulated in a collection tank maintained at a pressure higher than that present in the synthesis reactor and at a temperature higher than 150° C.

The second phase produced essentially consists of paraffinic waxes, liquid at the reaction temperature, comprising mixtures of saturated linear hydrocarbons, with a high number of carbon atoms. These are generally hydrocarbon mixtures which have a boiling point, at room pressure, higher than 150° C., for example from 160 to 380° C.

The Fischer-Tropsch reaction is carried out at temperatures equal to or higher than 150° C., for example ranging from 200 to 350° C., maintaining a pressure ranging from 0.5 to 20 MPa, inside the reactor. More significant details on Fischer-Tropsch reactions are available in "Catalysis Science and Technology" mentioned above.

The heavier liquid phase, discharged at the side of the reactor, contains the catalyst in suspension. Any catalyst based on cobalt capable of being active in the Fischer-Tropsch reaction can be used in the process, object of the present invention. The preferred catalyst, according to the present invention, is based on Co dispersed on a solid carrier consisting of at least one oxide selected from one or more of the following elements: Si, Ti, Al, Zr, Mg. Preferred carriers are silica, alumina or titania.

The cobalt is present in the catalyst in quantities ranging from 1 to 50% by weight, generally from 5 to 35%, with respect to the total weight.

The catalyst used in the process, object of the present invention, can comprise other additional elements. For example, it can comprise, with respect to the total, from 0.05 to 5% by weight, preferably from 0.1 to 3%, of ruthenium and from 0.05 to 5% by weight, preferably from 0.1 to 3%, of at least a third element selected from those belonging to group 3 (IUPAC regulation). Catalysts of this type are known in literature and described, together with their preparation, in European patent 756,895.

Further examples of catalysts are still based on cobalt but containing, as promoting element, tantalum in quantities of 0.05–5% by weight, with respect to the total, preferably 0.1–3%. These catalysts are prepared by first depositing a cobalt salt on the inert carrier (silica or alumina), for example by means of the dry impregnation technique, followed by a calcination step and, optionally, a reduction and passivation step of the calcined product.

A derivative of tantalum (particularly tantalum alcoholates) is deposited on the catalytic precursor thus obtained, preferably with the wet impregnation technique, followed by calcination and, optionally, reduction and passivation.

The catalyst, whatever its chemical composition may be, is used in finely subdivided powder form with an average diameter of the granules ranging from 10 to 700 μm.

The suspension discharged from the reactor is sent to a separation unit of the solid from the liquid which comprises a degasification step and two separation steps.

The degasification step comprises a vertical vessel in which the suspension remains for a time ranging from 1 to 5 minutes, during which entrained gas and vapours are released above the free surface of the suspension. The latter is then sent to the first primary separation step in which the solid particles with dimensions in the order of magnitude equal to or greater than a micrometer, are separated.

The fist separation step can be effected with devices such as decanters, trains of frontal filtration cartridges, magnetic filters and/or other devices known in the art.

At the end of the first separation, the sub-micronic particles, i.e. with average dimensions lower than 0.1 μm, still possibly present, are eliminated with the second separation step effected by means of micro/ultrafiltration. For specific application, for example at a temperature ranging from 210 to 240° C. and at a pressure ranging from 5 to 30 bar, multiple channel membranes can be used, made of ceramic materials, for example alumina or zirconia or titania, such as Membralox® or Schumasiv® produced by Pall Corporation, or sintered steel. Information on micro/ultra-filtration is available in W. S. Winston Ho, K. K. Sirkar "Membrane Handbook", Chapman & Hall, 28, 408, 1992 and D. Paulson, "Membranes, the Finest Filtration", Filtration News, 1995.

Downstream of the filtration step, the hydrocarbon liquid phase, substantially free of solid particles which can negatively influence the subsequent transformation phases, can be cooled to room temperature and stored in solid phase, or it can be sent to a transformation unit (hydrocracking and/or hydro-isomerization).

The solid particles recovered are recycled from the separation step to the synthesis reactor, in the form of a concentrated suspension. In order to limit the possible accumulation of fine sub-micronic particles in the reactor, it is possible to effect a purge of the concentrated stream from the micro/ultra-filtration unit and, contextually, reintegration with fresh catalyst.

The filtration units are periodically washed in countercurrent, at the end of their filtering cycle, with a stream of light hydrocarbons removed from the corresponding collection tank.

The process for the continuous production of hydrocarbons from synthesis gas, object of the present invention, can be better understood by referring to the plant scheme of the enclosed figure which represents an illustrative but non-limiting embodiment.

With reference to the figure, the scheme comprises a reactor R1 to which the synthesis gas is fed through line (1). Inside the reactor, there is a suspension consisting of the catalyst dispersed in the reaction liquid maintained in a state of stirring by the bubbles of synthesis gas which, on rising upwards, meet the particles of catalyst, keep them in suspension and react. The operating conditions of the reactor can be those described, for example, in international patent application WO 03/2246 or French patent 2,826,294.

A gaseous stream essentially consisting of the nonreacted gas and light reaction products and by-products, is discharged from the head of the reactor, through line (2), which is fed to a cooling and condensation section of the light fraction operating at a pressure close to that of the synthesis reactor. This comprises a first condenser C1, where the temperature of the stream is brought to values of about 100° C. The cooled stream is fed through line (3) to the separation vessel S1 from which the stream (4) is recovered, together with reaction by-products, consisting essentially of water, alcohols and ethers (5) and an organic phase consisting of liquid hydrocarbons (6).

The stream (4) is further cooled in a second condenser C2 and brought to a temperature of about 40° C. Also in this case, the product leaving the second condenser is fed to a second separation vessel S2, from which the gaseous stream (7), which can be recycled to the synthesis reactor R1, is recovered, together with the reaction by-products (8) and a second organic phase (9) which is joined to the previous one (6). These organic phases which form a light fraction produced in R1, are collected in a third separation vessel S3, operating at a lower pressure with respect to the other two. The last traces of water possibly present (10) are eliminated herein, whereas the hydrocarbon (organic phase) is partly removed (21), heated in the exchanger C3 and accumulated in the collection vessel V1 maintained at a higher pressure than that present in the synthesis reactor R1. The remaining part of the stream of light hydrocarbons can be discharged through line (22) and brought to room temperature or sent for subsequent treatment, for example, hydrocracking and/or hydro-isomerization.

The liquid hydrocarbon fraction produced together with the catalyst suspended therein, is discharged from the side of the reactor R1, through line (11). The suspension is first sent to a degasifier D, a vessel operating in continuous where the suspension releases the entrained gas. The latter is discharged at the head and fed, through line (12), to the condensation section of the light fraction, for example downstream of the first condenser C1.

The degassed suspension is fed to the separation section through line (13). The separation section comprises a first filtration unit F1 from which the catalyst, in the form of a concentrated suspension, is recycled with line 14 to the reactor R1 by means of a slurry pump PS. The latter is preferably a Discflo viscous entrainment pump consisting of a series of parallel disks, smooth or slightly corrugated, fitted onto the same shaft. This machine allows the suspension to be moved, by exploiting the viscous friction rather than the mechanical action exerted by blades, as in traditional centrifugal pumps, thus reducing the stress on the catalyst. The filtered liquid is collected in the vessel V2 and is removed therefrom and fed through (15) to a micro/ultra-filtration unit F2 for the separation of the sub-micronic catalyst particles still possibly present in the liquid. At the outlet of the unit F2, the liquid is substantially free of solid particles and can be sent, through line (16), for cooling and storage or to further processing phases not illustrated, for example hydrocracking operations. The fine micro/ultra-filtrated solid particles can be recycled to the synthesis reactor R1, through line (17) and the slurry pump PS, or recycled to the filter F2, through line (18).

In order to limit the possible accumulation of fine sub-micronic particles in the reactor R1, it is possible to effect a purge on the part of the concentrated stream coming from F2 through line (23) and reintegration with fresh catalyst through (24).

When the filtering capacity of the filtration units F1 and F2 is significantly reduced, they are detached and washed with the hydrocarbon liquid which has accumulated in the vessel V1. In particular, the light condensate, maintained in V1 at a temperature suitable for the washing process of the filters, is discharged in the two lines (19) and (20) and, sent through these to the two units F1 and F2 where the filtering elements are washed, also, for example, in countercurrent.

The invention claimed is:

1. A process for the production in continuous of hydrocarbons from synthesis gas which comprises:

a. continuously feeding to the bottom of a reactor for Fischer-Tropsch reactions, containing in suspension in the reaction product a catalyst based on supported cobalt, a synthesis gas consisting essentially of hydrogen and carbon monoxide;

b. continuously discharging from the head of the reactor, a vapour stream consisting essentially of light reaction products and non-reacted reaction gas;

c. continuously discharging from the reactor, the heavy reaction product consisting essentially of a liquid hydrocarbon phase containing the catalyst, in suspension;

d. condensing the light hydrocarbon products and sending at least part of them to a collection container maintained under pressure and at a temperature higher than 150° C. and the possible remaining part to be discharged, at room temperature, or to subsequent treatment units;

e. subjecting the heavy reaction product to a separation treatment which comprises: $e_1$ degasification; $e_2$ primary separation of the liquid from the solid; and $e_3$ micro/ultra-filtration of the fine or sub-micronic particles, still contained in the liquid after the primary separation, by means of membranes with an average pore diameter ranging from 0.002 to 0.1 μm;

f. sending the heavy reaction product, in liquid phase, having a content of fine or sub-micronic particles lower than 5 ppm to subsequent treatment units, or discharging it and cooling it to room temperature;

g. recycling to the reaction reactor the solids coming from the primary separation and micro/ultra-filtration steps; and h. periodically washing the separation and micro/ultrafiltration devices by means of flushings with the light hydrocarbon condensate.

2. The process according to claim 1, wherein the reactor for Fischer-Tropsch type reactions is a bubble reactor consisting of a vessel inside which chemical reactions are triggered, which take place in three-phase systems where a gaseous/vapour phase is bubbled into a suspension of a solid in a liquid.

3. The process according to claim 1 or 2, wherein the gaseous/vapour phase consists essentially of the synthesis gas and light reaction products in vapour phase, the dispersing liquid phase is the heavy reaction product or linear hydrocarbons, essentially with a high number of carbon atoms, and the solid phase is represented by the catalyst.

4. The process according to claim 1, wherein the light reaction products consist essentially of hydrocarbon mixtures with a number of carbon atoms ranging from 1 to 25 and a boiling point, for the $C_5$–$C_{25}$ fraction, equal to or lower than about 150° C.

5. The process according to claim 1, wherein the second phase produced consists essentially of paraffinic waxes, liquid at the reaction temperature, comprising mixtures of saturated, linear hydrocarbons, with a high number of carbon atoms having a boiling point, at atmospheric pressure, higher than 150° C.

6. The process according to claim 1, wherein the Fischer-Tropsch reaction is carried out at temperatures equal to or higher than 150° C., a pressure ranging from 0.5 to 20 MPa being maintained inside the reactor.

7. The process according to claim 1, wherein the catalyst is based on cobalt dispersed on a solid carrier selected from at least one oxide of one or more of the following elements: Si, Ti, Al, Zr, Mg.

8. The process according to claim 7, wherein the cobalt is present in quantities ranging from 1 to 50% by weight with respect to the total weight.

9. The process according to claim 7 or 8, wherein the catalyst comprises, with respect to the total, from 0.05 to 5% by weight of ruthenium and from 0.05 to 5% by weight of at least a third element selected from those belonging to group 3.

10. The process according to claim 7 or 8, wherein the catalyst comprises, as promoting element, tantalum in quantities ranging from 0.05–5% by weight, with respect to the total.

11. The process according to claim 1, wherein the catalyst is used in the form of a finely subdivided powder with an average diameter of the granules ranging from 10 to 700 μm.

12. The process according to claim 1, wherein the degasification step is carried out in a vertical vessel in which the suspension remains for a time ranging from 1 to 5 minutes.

13. The process according to claim 1, wherein the primary separation step is carried out with devices selected from decanters, trains of frontal filtration cartridges, magnetic filters.

14. The process according to claim 1, wherein the micro/ultra-filtration takes place at a temperature ranging from 210 to 240° C. and a pressure ranging from 5 to 30 bars in the presence of multiple channel membranes made of alumina, zirconia, titania or sintered steel.

15. The process according to claim 1, wherein the solid particles recovered from the primary filtration and micro/ultra-filtration unit are recycled to the synthesis reactor, in the form of a concentrated suspension.

16. The process according to claim 1, wherein, at the end of their filtering cycle, the filtration units are periodically washed in countercurrent with a stream of light hydrocarbons removed from the corresponding collection tank.

* * * * *